US005733414A

United States Patent [19]

Stockwell

[11] Patent Number: 5,733,414

[45] Date of Patent: Mar. 31, 1998

[54] PROCESS OF MAKING PAPER

[75] Inventor: John Oliver Stockwell, West Yorkshire, United Kingdom

[73] Assignee: Allied Colloids Limited, West Yorkshire, United Kingdom

[21] Appl. No.: 530,328

[22] PCT Filed: Feb. 6, 1995

[86] PCT No.: PCT/GB95/00231

§ 371 Date: Oct. 4, 1995

§ 102(e) Date: Oct. 4, 1995

[87] PCT Pub. No.: WO95/21295

PCT Pub. Date: Aug. 10, 1995

[30] Foreign Application Priority Data

Feb. 4, 1994 [GB] United Kingdom ..... 9402169

[51] Int. Cl.[6] ..... D21H 21/10

[52] U.S. Cl. ..... 162/164.5; 162/164.1; 162/165; 162/168.2; 162/168.3; 162/183

[58] Field of Search ..... 162/164.1, 164.5, 162/165, 183, 168.1, 168.2, 168.3, 168.4, 168.6

[56] References Cited

U.S. PATENT DOCUMENTS

| | | | |
|---|---|---|---|
| 4,070,236 | 1/1978 | Carrard et al. | 162/165 |
| 4,680,212 | 7/1987 | Blyth et al. | 428/97 |
| 5,538,596 | 7/1996 | Satterfield et al. | 162/164.5 |

*Primary Examiner*—Peter Chin

*Attorney, Agent, or Firm*—Sughrue, Mion, Zinn, Macpeak & Seas, PLLC

[57] ABSTRACT

During the manufacture of paper from a cellulosic suspension, retention is improved by adding to the suspension a water soluble cationic polymer containing 0.1 to 15 mole % cationic monomer groups and having an intrinsic viscosity of at least 4 dl/g and then adding a substantially water soluble formaldehyde condensate resin. This resin is preferably a phenol sulphone formaldehyde resin. Preferred phenol sulphone formaldehyde resins are materials wherein at last 70 mole % of the recurring groups are dihydroxyl phenyl sulphone groups free of sulphonic acid groups.

12 Claims, 3 Drawing Sheets

PROCESS OF MAKING PAPER

Figure 1:
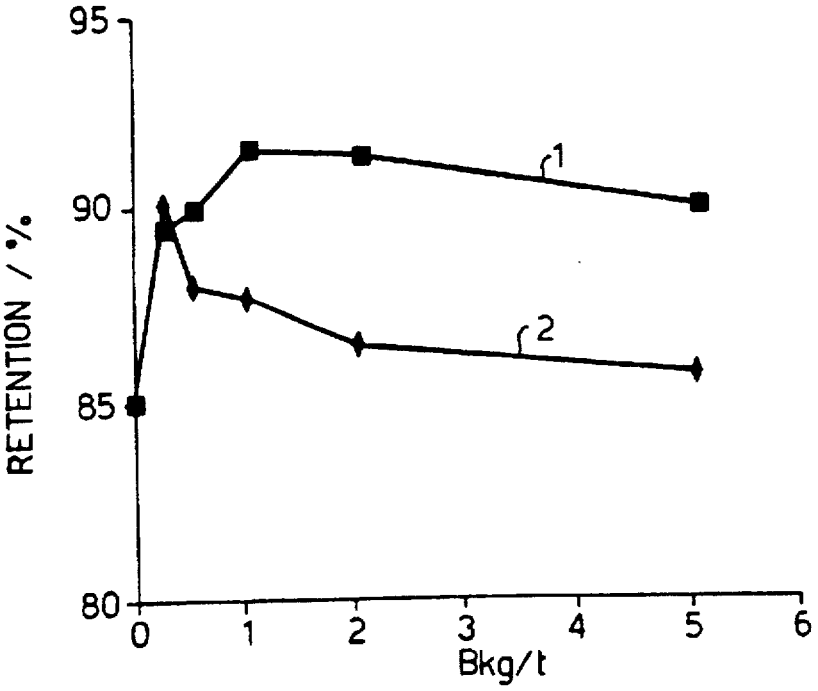

It is standard practice to make paper by a process comprising forming a cellulosic suspension, adding a retention system to the suspension, draining the suspension through a screen to form a sheet, and drying the sheet in conventional manner to make the desired paper, which can be a paper board.

The retention system is included in the suspension before drainage in order to improve retention of fibre and/or filler. The retention system can consist of a single addition of polymer in which event the polymer is usually a synthetic polymer of high molecular weight, or the retention system can comprise sequential addition of different retention aids. Before adding a high molecular weight polymer or other retention aid it is known to include low molecular weight cationic polymer, for instance as a wet strength resin or as a pitch control additive. The molecular weight of such polymers is generally too low to give useful retention.

A common retention system comprises the use of high molecular weight (for instance intrinsic viscosity above 4 dl/g) cationic polymer formed from ethylenically unsaturated monomers including, for instance, 10 to 30 mol % cationic monomer. Retention systems are also known in which high molecular weight non-ionic polymer or high molecular weight anionic polymer is used.

Some of the known retention systems using polymers formed from water soluble ethylenically unsaturated monomers can give good results on a range of pulps. For instance the Hydrocol (trade mark) process that uses a cationic polymer followed by a swelling clay (see EP-A-235893) gives good retention and drainage results on many stocks. However the need to handle and supply bentonite or other swelling clay is sometimes inconvenient and with some stocks a more cost effective treatment may be desirable, especially when good formation is required.

The use of phenol- or napthol- sulphur resins, or of phenol- or napthol- formaldehyde resins, followed by polyethylene oxide is described in U.S. Pat. No. 4,070,236. The phenol formaldehyde resins are exemplified by commercial products and it is stated that the preferred products are formed by condensation of formaldehyde with m-xylene sulphonic acid and dihydroxy diphenyl sulphone. The commercial products that are named are described as synthetic tanning agents. The molar proportions used for making the phenol formaldehyde resins are not described but we believe that the commercial tanning agents were probably made using an amount of the sulphone such as to provide about half the recurring groups in the polymer.

We are aware that there has been some commercial use of retention systems comprising water soluble phenol formaldehyde resin followed by polyethylene oxide on relatively dirty cellulosic suspensions (i.e., suspensions having a high cationic demand). Although in some instances such processes have given useful results, they have proved to be of very limited commercial applicability.

It would be desirable to provide an entirely new type of retention system since this would afford the opportunity to optimise it for a wide variety of stocks and would give the paper-maker a widened choice of retention systems. It would also be desirable to provide such a system that can give a good combination of retention, drainage and formation on a variety of stocks, including dirty stocks. It would be desirable to provide a system that utilises cost effective materials that are easy to handle, and that preferably does not require the use of bentonite or other swelling clay.

According to the invention, a process of making paper comprises forming a cellulosic suspension, adding to the suspension a water soluble cationic retention aid which is a polymer which is cationic in the suspension and which is formed from a water-soluble ethylenically unsaturated monomer blend containing 0.1 to 15 mol % cationic (including potentially cationic) monomer, and has intrinsic viscosity at least 4 dl/g, and then adding a substantially soluble condensate of formaldehyde with one or more aromatic hydroxyl compounds and/or aromatic sulphonic acid compounds, draining the suspension through a screen to form a sheet, and drying the sheet.

We believe that some type of complex formation occurs between the absorbed cationic polymer and the formaldehyde condensate and in some instances a gelatinous rheology is obtained when adding a solution of the condensate to a solution of the cationic polymer at the pH of the suspension when the cationic content of the cationic polymer is suitable for the particular stock pH and formaldehyde condensate.

The formaldehyde condensate can be a condensate of formaldehyde with naphthalene sulphonic acid and optionally a phenolic material. Preferably it is a condensate of formaldehyde with a phenolic compound (for instance phenol itself), optionally also with an aromatic sulphonic acid that can be condensed with formaldehyde, for instance a phenol sulphonic acid.

The amount of formaldehyde per mole of aromatic compound is preferably 0.7 to 1.2 moles, preferably 0.8 to 0.95 or 1 moles.

The preferred formaldehyde condensate for use in the invention is phenolsulphone-formaldehyde resin (PSR resin) consisting essentially of recurring units of the formula $$—CH_2—X—$$

wherein (a) 10 to 100% of the groups X are di(hydroxyphenyl) sulphone groups, (b) 0 to 90% of the groups X are selected from hydroxy phenyl sulphonic acid groups (i.e., groups which contain at least one hydroxy-substituted phenyl ring and at least one sulphonic group) and naphthalene sulphonic acid groups and (c) 0 to 10% of the groups X are other aromatic groups, the percentages being on a molar basis.

The amount of groups (a) is usually at least 40%, and preferably at least 65% or at least 70%. It can be 100%, but is often not more than about 95%, with amounts of 75 or 80% to 95% often being preferred.

The amount of groups (b) can be zero, but it is usually desirable to include at least about 5% in order to improve the solubility of the resin. It is usually not more than 60%, although higher amounts can be used especially when the groups (b) are also groups (a). The amount of groups (b) is often in the range 5 to 35%, preferably 5 to 25%.

Groups (c) do not usually contribute usefully to the performance of the PSR and so the amount of them is usually low, often zero.

Although all the groups (b) can be naphthalene sulphonic acid groups, usually at least half, and preferably all the groups (b) are hydroxy-phenyl sulphonic acid groups.

Instead of using hydroxy phenyl sulphonic acid groups and/or napthalene sulphonic acid groups as (b) it is possible to use any other aromatic sulphonic acid groups that are condensable into the formaldehyde condensate. Such other groups include substituted phenyl sulphonic acids such as, for instance, m-xylene sulphonic acid, but these are usually less preferred.

Any groups (c) are usually hydroxy-phenyl groups, most usually phenol or a substituted phenol.

When some or all of groups (b) are di(hydroxy-phenyl) sulphone groups which are substituted by sulphonic acid, these groups will count also as groups (a). Preferably at least half the groups (a), and usually at least three quarters and most preferably all the groups (a), are free of sulphonic acid groups.

The preferred PSR resins include 40 to 95% (usually 50 to 95% and most preferably 70 or 75% to 90 or 95%) di(hydroxy-phenyl) sulphone groups free of sulphonic acid groups and 5 to 60% (usually 5 or 10% to 25 or 30%) hydroxy phenyl sulphonic acid groups free of di(hydroxy-phenyl) sulphone groups and 0 to 10% other hydroxyl-phenyl groups.

The methylene linking groups in the PSR resins are usually ortho to a phenolic hydroxyl group and suitable PSR resins can be represented as having the following recurring groups.

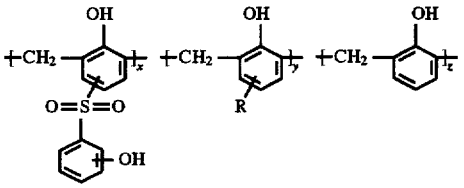

where

R is $SO_3H$ and x is 0.1 to 1.0, y is 0 to 0.9, z is 0 to 0.1 and x+y+z=1.

x is usually in the range 0.5 to 0.95. Preferably it is at least 0.7 and usually at least 0.75 or 0.8. Often it is not more than 0.9. y is usually 0.05 to 0.6. Often it is not more than 0.25 or 0.3. Often it is at least 0.1.

The groups may all be arranged as illustrated with each methylene linkage being ortho to a phenolic hydroxyl and with methylene linkages being meta to each other. However this is not essential and the methylene linkages may be bonded into any convenient place of each aromatic ring. In particular, it is preferred that some or all of the dihydoxy phenyl sulphone groups have the methylene linkages going on to the two phenyl rings, so that one methylene linkage is on to one phenyl ring and the other methylene linkage is onto the other ring. The various rings may be optionally substituted and usually have the sulphone group and the group R para to the phenolic hydroxyl group, as discussed below.

Preferred compounds have the formula shown above wherein x is 0.75 to 0.95, y is 0.05 to 0.25 (preferably 0.05 to 0.2), z is 0 to 0.1 (preferably 0) and R is $SO_3H$. These novel compounds are useful as retention aids in the manufacture of paper (especially in the process of the invention) and as carpet stain blockers (see for instance U.S. Pat. No. 4,680,212). The characteristic content of sulphonic groups permits the compounds to be made easily to a particularly suitable combination of high molecular weight and solubility. The molecular weight of the new compounds is preferably such that they have a solution viscosity mentioned below, preferably above 200 cps or more.

The sulphonic acid groups may be in the form of free acid or water soluble (usually alkali metal) salt or blend thereof, depending on the desired solubility and the conditions of use.

The PSR resin may be made by condensing 1 mole of the selected phenolic material or blend of materials with formaldehyde in the presence of an alkaline catalyst. The amount of formaldehyde should normally be at least 0.7 moles, generally at least 0.8 and most preferably at least 0.9 moles per mole of A+B+C. The speed of the reaction increases, and the control of the reaction becomes more difficult, as the amount of formaldehyde increases and so generally it is desirable that the amount of formaldehyde should not be significantly above stoichiometric. For instance generally it is not more than 1.2 moles and preferably not more than 1.1 moles. Best results are generally obtained with around 0.9 to 1 mole, preferably about 0.95 moles formaldehyde.

The phenolic material that is used generally consists of (A) a di(hydroxyphenyl)sulphone, (B) a sulphonic acid selected from phenol sulphonic acids and sulphonated di(hydroxyphenyl)sulphones (and sometimes naphthalene sulphonic acid) and (C) 0 to 10% of a phenol other than a or b, wherein the weight ratio a:b is selected to give the desired ratio of groups (a):(b). Usually the ratio is in the range 25:1 to 1:10 although it is also possible to form the condensate solely from the sulphone (a), optionally with 0–10% by weight (c). Generally the ratio is in the range 20:1 to 1:1.5 and best results are generally obtained when it is in the range 20:1 to 1:1, often 10:1 to 2:1 or 3:1.

Component (A) is free of sulphonic acid groups. It is generally preferred that at least 50% by weight of component (B) is free of di(hydroxyphenyl)sulphone groups and preferably all of component (B) is provided by a phenol sulphonic acid.

Other phenolic material (C) can be included but is generally omitted.

The preferred PSR resins are made by condensing formaldehyde (generally in an amount of around 0.9 to 1 mole) with 1 mole of a blend formed of 95 to 40 parts by weight (preferably 95 to 80 or 75 parts by weight) di(hydroxyphenyl)sulphone that is free of sulphonic acid groups with 5 to 60 (preferably 5 to 25 or 30) parts by weight of a phenol sulphonic acid.

The di(hydroxy-phenyl)sulphone is generally a symmetrical compound in which each phenyl ring is substituted by hydroxy at a position para to the sulphone group, but other compounds of this type that can be used include those wherein either or both of the hydroxy groups is at an ortho or meta position to the sulphone group and those wherein there are non-interfering substituents elsewhere in the ring.

The hydroxyphenyl sulphonic acid generally has the hydroxyl group of the phenyl in a position para to the sulphonic acid group, but other compounds of this type that can be used include those wherein the sulphonic acid group is ortho or meta to the hydroxyl group and those wherein there are other non-interfering substituents elsewhere in the ring.

Other phenyls that can be included are unsubstituted phenyls and phenyl substituted by non-interfering groups.

Typical non-interfering groups may be included in any of the phenyl rings include, for instance, alkyl groups such as methyl.

The molecular weight of the condensate is preferably such that a 40% aqueous solution of the full sodium salt of the sulphonic acid groups of the condensate has a solution viscosity of at least 50 cps, generally at least 200 cps and typically up to 1000 cps or more, when measured by a Brookfield viscometer using spindle 1 at 20 rpm and 20° C.

Suitable PSR resins having a content of phenol sulphonic acid are available from Allied Colloids Limited under the tradenames Alcofix SX and Alguard NS. The preferred novel compounds can be synthesised as described above.

The cationic polymer should be soluble in water and preferably is a substantially linear polymer formed in the absence of cross linking agent under conditions that provide a polymer that has high solubility typical of cationic retention aids. However if desired the polymer may have partial insolubility, as described in EP-A-202780, for instance due to the use of 5 to 50 ppm polyethylenically unsaturated cross linker in the preparation of a high molecular weight revere phase emulsion polymer.

The cationic polymer should be cationic in the suspension as measured by a Mutek or other suitable Particle Charge Detector. The total proportion of cationic groups must be quite low as otherwise satisfactory results are not obtained. Usually it is below 10 mole % and usually below 7 mole %. Anionic (including potentially anionic) groups may be included. If they are in free acid form (i.e., potentially anionic) they may not reduce the cationic nature of the polymer but if they are in ionised form in the suspension the molar amount of ionised anionic groups should usually be at least 1 mol % less than the amount of cationic monomer (so that the polymer behaves primarily as a cationic polymer).

The remainder of the monomer blend is non-ionic. Any of the conventional water-soluble ethylenically unsaturated non-ionic monomers can be used, acrylamide being the most common.

The preferred polymers are formed by copolymerising 0.1 to 15 mol % cationic monomer together with 99.9 to 70 (often 99.9 to 85) mole % non-ionic monomer and 0 to 20 (often 0 to 14.9) mole % anionic monomer. Preferably the amount of ionised or free acid anionic groups is at least 1 mol % less than the amount of cationic monomer, and is often not more than about 1 or 2 mol %. The amount of cationic monomer is usually at least 0.5 mole % and below 7 mole %, preferably below 6 mole %.

The non-ionic monomer is preferably acrylamide, optionally contaminated with trace amounts of sodium acrylate, but other water-soluble, ethylenically unsaturated monomers can be used.

The anionic monomer may be water-soluble ethylenically unsaturated carboxylic acid or sulphonic acid monomer, usually acrylic acid (or an alkali metal or other water soluble salt).

The cationic monomer is preferably dialkyl amino alkyl (meth) -acrylate or -acrylamide as acid addition or quaternary ammonium salt or as potentially cationic free base, or diallyldialkyl quaternary monomer. Preferred cationic monomers are diallyldimethyl ammonium chloride, dimethylamino ethyl (meth) acrylate and dimethylaminopropyl (meth) acrylamide in the form of acid addition or quaternary ammonium salts. However in some suspensions it is possible to supply the polymer as a free base and convert it into the salt form in the suspension.

The intrinsic viscosity of the cationic polymer is generally above 6 dl/g, e.g. 7 to 12 dl/g or more. IV is measured by suspended level viscometer at 25° C. in buffered IN NaCl.

The amount of the high molecular weight cationic polymer that is added to the cellulosic suspension is usually at least 25 g/t and is usually at least 100 g/t (i.e., grams per tonne based on dry weights). Best results are generally obtained when the amount is above 200 g/t, frequently above 500 g/t. It is generally unnecessary for the amount to be above 2,000 g/t. The amount of the condensate is often in the range 500 to 3000 g/t.

The dry weight ratio of cationic polymer:formaldehyde condensate is 4:1–1:10 preferably at least 2:1 and is generally at least 1:1. It can be as much as 1:6 but it is generally unnecessary for it to be above 1:3.

The cationic polymer is preferably incorporated into the cellulosic suspension before adding a solution of the formaldehyde condensate. The cationic polymer can be provided initially to the user as, for instance, a powder or a reverse phase emulsion. It can be incorporated into the suspension in conventional manner, for instance by initially converting it to a dilute aqueous solution (e.g., 0.01 to 3% by weight polymer) and adding that solution to the suspension.

When the cationic polymer is added to the cellulosic suspension, visible flocculation usually occurs, and the initial flocs that are formed may be broken down to smaller flocs before the anionic polymer is added. The initial flocs may be broken down to smaller flocs solely by turbulence in the suspension as it flows to the point of which the anionic polymer is added or the flocs may be broken by the application of a deliberate shear stage such as a pump or centriscreen between the dosage points for the cationic polymer and the formaldehyde condensate.

We believe the use of a high molecular weight, low charge, cationic polymer is needed to allow the polymer chains to be absorbed onto the cellulosic fibres (and filler if present) in the suspension. We believe that the exposed parts of the cationic polymer molecules are exposed to, and are subjected to ionic or hydrogen bonding to, the bulkier, shorter chain length, condensate polymer molecules. We believe these are thereby insolubilised and cause a super-coagulation effect somewhat similar to the effect that is obtained upon the addition of swelling clay in the Hydrocol process.

The process does, however, normally give a smaller floc structure that is obtained when using a swelling clay (in the absence of shearing the flocs), and so gives very good formation.

The process can be used successfully on a wide range of cellulosic suspensions. The suspension can be clean or dirty (i.e., they can have low or high cationic demand). They can be filled or unfilled.

The use of the defined retention system is of particular value when the suspension is relatively dirty and contains lignins and anionic trash. The dirty suspension can be dirty due to the inclusion of a significant amount, for instance at least 25% and usually at least 50% dry weight, of a dirty pulp such as a pulp selected from ground wood, thermomechanical pulp, de-inked pulp, and recycled pulp. Many paper mills now operate on a partially or wholly closed system with extensive recycling of white water, in which event the suspension may be relatively dirty even though it is made wholly or mainly from clean pulps such as unbleached/or bleached hardwood or softwood pulps, and the invention is of value in these closed mills. Typical dirty suspensions have a cationic demand of at least 0.05 meq/l, usually at least 0.1 and most usually at least 0.03 meq/l and up to, for instance 0.6 meq/l. In this specification cationic demand is the amount of polydiallyl dimethyl ammonium chloride homopolymer (POLYDADMAC) having intrinsic viscosity about 1 dl/g that has to be titrated into the suspension to obtain a point of zero charge when measuring streaming current potential using Mutek PCD 02 instrument.

The invention can also successfully be applied to the treatment of any of the conventional suspensions which can be clean or reasonably clean and can be used for making a wide range of papers including newsprint, tissue, fine paper and other grades of paper (including board). Typical clean suspensions are made from unbleached and/or bleached hardwood or softwood pulps and have low cationic demand (below 0.1 and usually below 0.05 meq/l).

The suspension may be substantially unfilled, for instance containing not more than about 5% or 10% by weight (based on the dry weight of the suspension) filler, or the suspension may be filled. Some or all of the filler may be introduced as a result of some or all of the suspension being derived from de-inked pulp or broke. Filled suspensions are made by the deliberate addition of inorganic filler, typically in amounts of from 10 to 60% by weight based on the dry weight of the suspension.

The suspension may, before addition of the retention aids, have had conventional additives included in it such as bentonite, cationic starch, low molecular weight cationic polymers and other polymers for use as, for instance, dry or wet strength resins.

It may be desirable to select the ionic content of the cationic polymer and the solubility (for instance the proportion of sulphonic groups) of the condensate according to the pH of the suspension, in order that the desired degree of insolubilisation or other interaction occurs. By such selection, it is possible to obtain good results in acidic suspensions, for instance pH4–6, as well as in suspensions having higher or alkaline pH values.

In the following examples of the invention, 500 ml of a paper stock was stirred at 1000 rpm in a Britt jar, the first retention aid was added as a solution and the suspension stirred for 30 seconds and the second component was then added as a solution and stirred for 30 seconds. 500 ml of the treated suspension was then filtered through a 75 μm filter. The first 30 ml was discarded and the solids content of the following 100 ml was recorded and utilised to express % retention.

Drainage time is determined, on a suspension prepared in this manner, by a modified Schopper Riegler test.

A is a PSR formed from formaldehyde with p-di (hydroxyl phenyl) sulphone and p-phenol sulphonic acid in a weight ratio of 50:50

B is a PSR formed from the same materials but with a weight ratio of 70:30

$A^1$ is a similar product but with a ratio 60:40

$B^1$ is a similar product but with a ratio 80:20

$B^{11}$ is a product similar to B but of higher molecular weight

C is a PSR formed from the same materials but with a weight ratio 90:10

D is a copolymer of acrylamide and dimethylaminoethyl acrylate MeCl quaternary salt having IV 10–12 dl/g and a cationic charge of 3.5% by weight (measured by Mutek PCD02, titrated against poly DADMAC)

E is a copolymer of the same monomers but 6% cationic and IV=11.6

F is a copolymer of the same monomers, 6% cationic, IV=15.5

G is a copolymer of the same monomers, 1% cationic, IV=10.7

H is a copolymer of the same monomers, 3% cationic, IV=11.6

I is a copolymer of the same monomers, 9% by weight cationic, IV=11.5

J is a copolymer of the same monomers, 10% by weight cationic.

The tables shown in each of Examples 1, 2 and 3 show drainage times obtained on a pressure groundwood pulp mill stock. This demonstrates the significant improvement in drainage obtained by adding the PSR after the cationic polymer.

Figure 2:
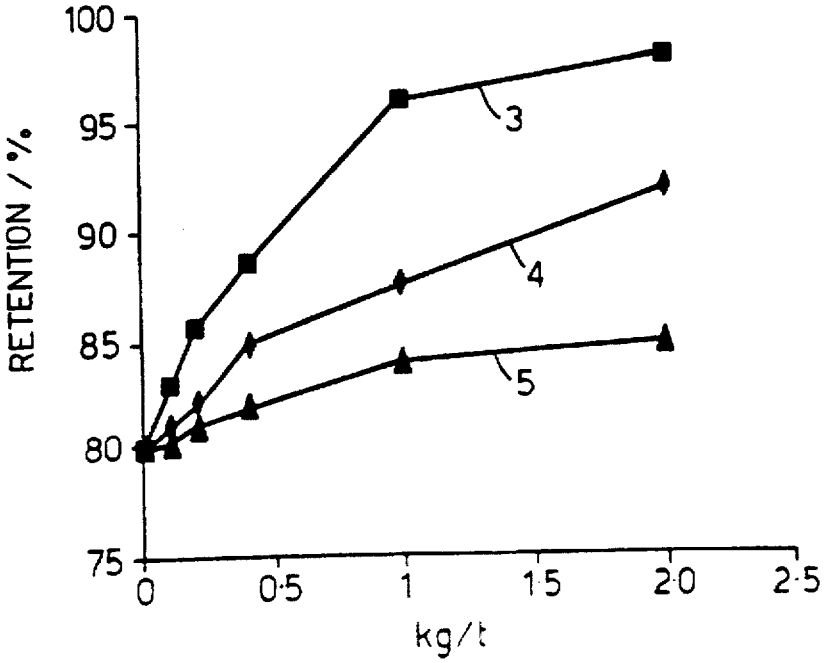

FIG. 1 and FIG. 2 show retention values on a 1% groundwood stock.

In FIG. 1, 1 represents D then B while 2 represents B then D. D is applied at 500 g/t and the dose of B is shown. FIG. 1 shows that good retention can be obtained using PSR followed by cationic, but that the effect is dose sensitive in this particular test. FIG. 1 also shows that better retention, that is not dose sensitive is obtained using cationic followed by PSR, with best results when the ratio is about 1:2.

FIG. 2 confirms the benefit of this process. 3 represents D then B (ratio 2:1), 4 represents D alone and 5 represents B alone. The dose of B/D/D+B is shown.

Figure 3:
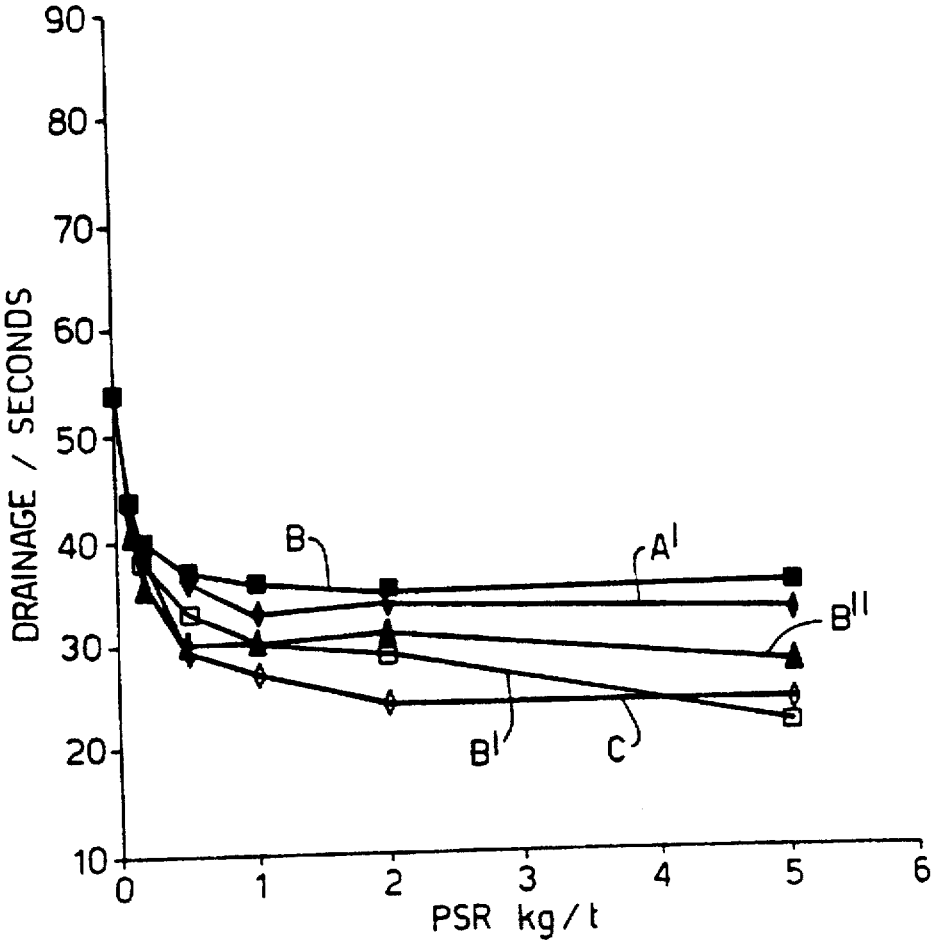

FIG. 3 shows drainage times for various PSR resins using groundwood stock and shows the remarkably fast drainage obtained by the invention. It also shows improvement with reduction in the amount of sulphonic acid groups, best results being obtained at 80:20 and 90:10. The floc size in these tests was small, indicating that the sheet will have good formation. The amount of D is 1000 g/t, added before the PSR. The dosage of the PSR is as shown.

Figure 4:
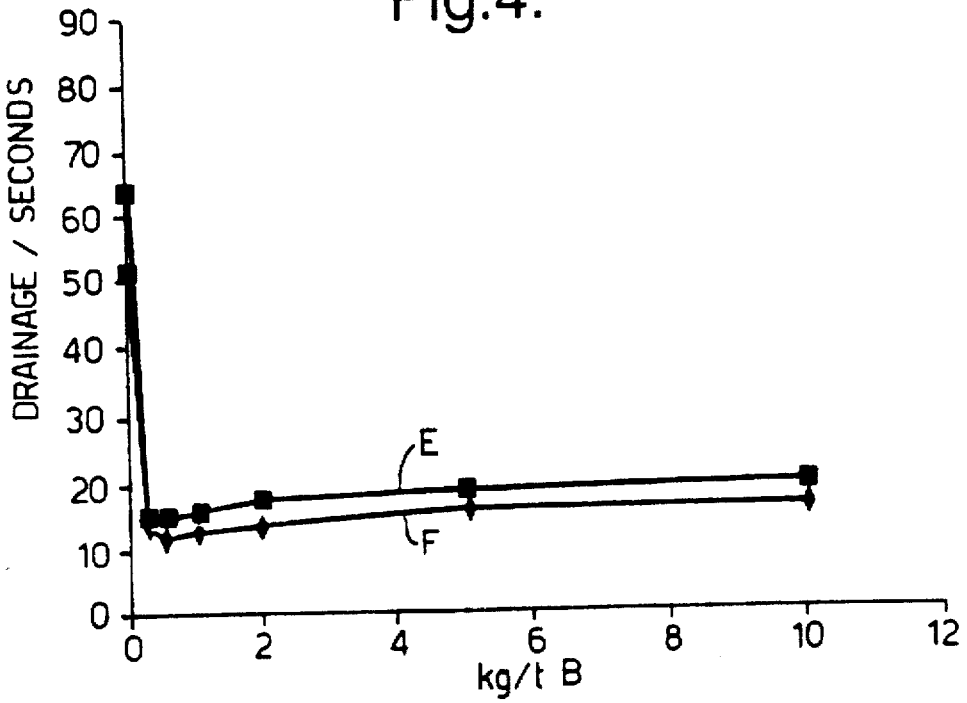

FIG. 4 shows drainage values on TMP mill stock using polymers E or F at 1000 g/t before the shown amounts of polymer B. It demonstrates that there may be an improvement in performance as the IV of the cationic polymer increases. Again floc size was small.

Figure 5:
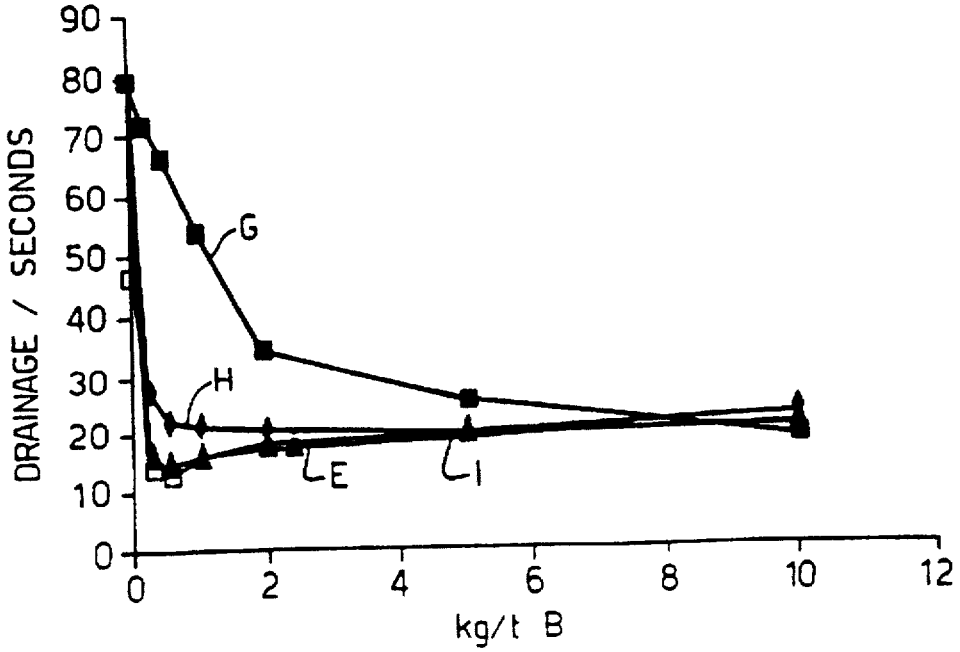

FIG. 5 shows drainage values on TMP mill stock using polymers E, H, G or I at 1000 g/t with the shown amounts of B. It demonstrates that as cationic content increases up to 9% there is an improvement in performance. Again floc size was small.

It is very unusual to obtain this combination of fast drainage with small, tight flocs. These results demonstrate that the process of the invention can give an excellent combination of drainage rate, retention, drying rate, and formation.

EXAMPLE 1

Polymer D alone

| D g/t | drainage / seconds |
|---|---|
| 0 | 182 |
| 100 | 207 |
| 200 | 207 |
| 500 | 205 |
| 1000 | 196 |
| 2000 | 182 |
| 4000 | 186 |

2000 g/t D followed by PSR

| PSR / g/t | B | C |
|---|---|---|
| 1000 | 147 | 149 |
| 2000 | 145 | 113 |
| 4000 | 131 | 77 |
| 10000 | 91 | 77 |
| 20000 | 65 | 83 |

EXAMPLE 2

Polymer E alone

| E g/t | drainage / seconds |
|---|---|
| 500 | 180 |
| 1000 | 172 |
| 2000 | 173 |
| 4000 | 173 |

2000 g/t E followed by PSR

| PSR / g/t | B | C |
|---|---|---|
| 500 | 65 | 124 |
| 1000 | 65 | 89 |
| 2000 | 69 | 71 |
| 4000 | 73 | 65 |
| 10000 | 82 | 82 |

EXAMPLE 3

2000 g/t polymer J followed by PSR (polymer alone gave drainage time of 135 seconds)

| PSR / g/t | B | C |
|---|---|---|
| 500 | 42 | 64 |
| 1000 | 37 | 47 |
| 2000 | 41 | 41 |
| 4000 | 55 | 39 |
| 10000 | 57 | 48 |

I claim:

1. A process of making paper which comprises forming a cellulosic suspension, adding to the suspension a water soluble high molecular weight retention aid and thereby flocculating the suspension, and then adding a substantially soluble condensate of formaldehyde with one or more aromatic compounds selected from phenyl hydroxyl compounds and phenyl sulphonic acid compounds, wherein the amount of formaldehyde per mole of aromatic compound in said condensate is 0.7 to 1.2 moles, wherein a 40% aqueous solution of the full sodium salt of the sulphonic acid groups of the condensate have the solution viscosity of at least 50 cps measured by a Brookfield viscometer spindle 1, 20 rpm, 20° C., draining the suspension through a screen to form a sheet, and drying the sheet, wherein the high molecular weight retention aid consists of a polymer formed by copolymerizing water soluble ethylenically unsaturated monomer blend containing the following:

(1) 0.1 to 15 mole percent ethylenically unsaturated cationic monomer in salt or free base form, wherein said cationic monomer is selected from the group consisting of dialkyl amino alkyl (meth) acrylate, dialkyl amino alkyl (meth) acrylamide and diallyldimethyl quaternary monomer, (2) 99.9 to 70 mole percent water-soluble ethylenically unsaturated non-ionic monomer, and, optionally, (3) water-soluble ethylenically unsaturated carboxylic acid or sulphonic acid anionic monomer in an amount which is from zero up to an amount which is at least 1 mole percent less than the molar amount of cationic monomer, wherein said retention aid has intrinsic viscosity at least 4 dl/g and is used in an amount of 25 to 2000 g/t, and the condensate is used in an amount of at least 500 g/t and the ratio dry weight of said retention aid to said condensate is from 4:1 to 1:10.

2. A process according to claim 1 in which the condensate of formaldehyde is phenolsulphone-formaldehyde resin (PSR resin) consisting essentially of recurring units of the formula $$—CH_2—X—$$

wherein (a) 65 to 95% of the groups X are di(hydroxyphenyl) sulphone groups, (b) 5 to 35% of the groups X are selected from hydroxy phenyl sulphonic acid groups (i.e., groups which contain at least one hydroxy-substituted phenyl ring and at least one sulphonic group) and naphthalene sulphonic acid groups and (c) 0 to 10% of the groups X are other aromatic groups, the percentages being on a molar basis.

3. A process according to claim 2 in which the amount of groups (a) is 70 to 95% and the amount of groups (b) is at least 5%.

4. A process according to claim 2 in which the PSR resin is formed from dihydroxyl phenyl sulphone groups free of sulphonic acid groups and hydroxy phenyl sulphonic acid groups free of dihydroxy phenyl sulphone groups.

5. A process according to claim 2 in which the PSR resin has the following recurring groups

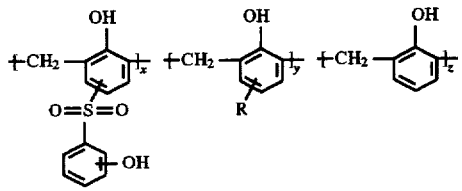

where R is $SO_3H$ or compounds wherein the methylene linkages may be substituted into other positions in the rings and wherein x is 0.7 to 0.95, y is 0.05 to 0.3 and z is 0 To 0.1 and x+y+z=1.

6. A process according to claim 2 in which the PSR resin is formed from 75 to 95% di-hydroxy phenyl sulphone groups and 5 to 25% hydroxy phenyl sulphonic acid groups.

7. A process according to claim 2 in which a 40% aqueous solution of the full sodium salt of the condensate has a solution viscosity of at least 200 cps when measured by a Brookfield viscometer using spindle 1 at 20 rpm at 20° C.

8. A process according to claim 7 in which the amount of cationic monomer is 0.5 to 7 mole %.

9. A process according to claim 2 in which the dry weight ratio of cationic polymer:formaldehyde condensate is 4:1 to 1:10.

10. A process according to claim 8, wherein said anionic monomer is not present.

11. A process according to claim 1 in which the amount of non-ionic monomer is 99 to 70 mole percent.

12. A process according to claim 8 in which the amount of cationic monomer is below 6 mole %.

* * * * *